United States Patent [19]

Stoner

[11] 4,269,109

[45] May 26, 1981

[54] OPEN-FRAMEWORK RECEIVER AUTOMATIC CANNON

[75] Inventor: Eugene M. Stoner, Stuart, Fla.

[73] Assignee: ARES, Inc., Port Clinton, Ohio

[21] Appl. No.: 24,186

[22] Filed: Mar. 27, 1979

[51] Int. Cl.[3] ..... F41D 11/12

[52] U.S. Cl. ..... 89/198; 89/44 R; 89/191 R; 89/199; 89/132

[58] Field of Search ..... 89/44 R, 198, 199

[56] References Cited

U.S. PATENT DOCUMENTS

| | | | |
|---|---|---|---|
| 1,359,045 | 11/1920 | Fisher | 89/198 |
| 2,167,672 | 8/1939 | Nomar | 89/199 |
| 3,057,100 | 10/1962 | Dixon | 89/198 |
| 3,635,123 | 1/1972 | Colby | 89/198 |
| 3,999,461 | 12/1976 | Johnson et al. | 89/198 |

OTHER PUBLICATIONS

Webster's New World Dictionary, 1957, p. 180.

*Primary Examiner*—Stephen C. Bentley
*Attorney, Agent, or Firm*—Allan R. Fowler

[57] ABSTRACT

An open-framework receiver automatic cannon comprises a cannon barrel and a breech ring mounting the barrel and through opposite sides of which intermediate regions of first and second elongate rigid tubular support members are received, with longitudinal axes thereof parallel to, equally spaced to sides of, and coplanar with, a barrel bore axis. Forward and rearward ends of the support members are respectively interconnected by a barrel support and a detachable recoil buffer which includes a bolt sear. Reciprocating movement of a bolt and a bolt carrier assembly is guided by longitudinal slots in the support members and a plate mounted between the buffer and breech ring. Disposed in the support members are means for driving the bolt assembly forwardly on unsearing; apparatus for causing recoil of the bolt carrier after firing to enable bolt unlocking and inertia means for reducing bolt carrier bounce from the breech ring on forward impact. A barrel gas manifold provides pressurized gas to operate the bolt carrier recoil apparatus and a gas operated shell feeder. Mounted around the support members are cannon mounting cylinders housing a large number of cannon recoil springs.

12 Claims, 13 Drawing Figures

10
12
14
16
18
20
22
24
26
28
30
32
40
42
46
52
78
80
82
88
100
110
120
122
130
132
136
152
154
156
176
178
182
186
188
198
288
290
292
346
376
378

OPEN-FRAMEWORK RECEIVER AUTOMATIC CANNON

The present invention relates to the field of automatic guns, and more particularly to receiver portions of automatic cannon.

Gas operated automatic cannon and the like have heretofore been constructed with comparatively large and massive receivers. In these receivers are typically installed or "received" such parts of the gun as a reciprocating bolt and bolt carrier assembly, bolt carrier recoil mechanism, a bolt recoil buffer, a shell casing ejector, a sear and portions of triggering apparatus. As such, the receivers function to maintain the received parts in a predetermined spatial arrangement and to provide tracks, slots and so forth for guiding movement of parts during firing. Although mechanical and environmental protection for the received parts is also provided by the receiver, such protection is usually unnecessary, since receiver portions of the cannon are ordinarily mounted in enclosures, for example, turrets, support cradles, or aircraft weapons pods.

Because complex internal configuration is necessary to accommodate and guide movement of the received parts, receivers are ordinarily the most difficult and time consuming, and accordingly the most expensive, part of the cannon to construct. In addition, costly manufacturing equipment is required, as are skilled manufacturing personnel. As a result of this internal complexity, receivers for some types of large automatic guns must, as an example, be constructed of two separately machined half sections. After machining of the half sections, and after considerable jigging and clamping, the half sections are welded together to complete the receiver. Long lead times are routinely required for constructing receivers of all types; consequently, final assembly of otherwise finished automatic cannon is often considerably delayed awaiting completion of the receivers.

Furthermore, due to heavy, box-like construction, gun receivers are usually one of the heaviest parts, if not the heaviest part, of the gun. Frequently, receiver portions weigh two or three times as much as the associated gun barrel. As an illustration, typical 35 mm automatic cannon have heretofore had a barrel weight of about 300 pounds and a receiver weight of about 800 pounds.

Although some advantages may be associated with comparatively massive receivers—barrel recoil is generally reduced as are gun mount reaction forces—massive receivers are generally disadvantageous. Cannon having large and massive receivers are difficult to handle and to transport, and are not well suited to most airborne applications. In the field, where availability of repair equipment is limited, because heavy receivers of large automatic cannon are difficult to handle, gun repairs are time consuming. Routine preventive maintenance, such as inspection, cleaning and greasing, is also neglected, reliability being thereby affected.

Automatic cannon with massive receivers have limited usefulness not only in airborne applications, but also in mobile applications in which cannon carrying vehicle speed, range and maneuverability are important. Even if having a massive receiver may not preclude use of a particular type of cannon in such applications, the weight of ammunition that can be carried is correspondingly reduced with weapon system effectiveness being adversely affected.

A further disadvantage of massive cannon receivers is apparent in uses in which the cannon are mounted to rotatable turrets or platforms. In such applications, rapid, precise movement of the turrets or platforms to track fast moving targets, such as attacking aircraft, is made more difficult; that is, because of high cannon inertia, rapid acceleration and deceleration of the turrets or platforms during target tracking is difficult to achieve and control precisely. To offset this, greater auxillary power and heavier drive systems must usually be provided for heavy guns than for light guns, thereby further increasing mass of the entire weapon system.

Also associated with most heretofore available large automatic cannon, often a result of trying to minimize receiver size and weight, are non-symmetrical bolt carrier recoil and drive apparatus. Typically, one or two recoil cylinders, disposed below the barrel axis, are used to contain apparatus which impart recoil to the bolt carrier after firing to enable unlocking of the bolt from the breech, and for driving the bolt carrier and bolt forwardly from the sear when firing is initiated. As a result, firing transmits eccentric forces to the cannon barrel and causes whipping thereof. Such barrel whipping increases dispersion of fired projectiles, particularly at high firing rates which not not permit the whipping to be fully damped out between shots.

Other, less conventional automatic cannon, such as multi-barreled, Galting-gun types and multi-chambered, revolver types, since an axially reciprocating bolt assembly principle is not utilized, may have less complex receiver or breech end portions. However, such cannon have various other disadvantages, such as being otherwise more complex to manufacture, being also relatively massive and usually requiring external barrel or cylinder drives. Thus, these types of cannon have not replaced conventional, bolt actuated gas operated cannon in most ground based applications, in particular those applications requiring relatively large calibre cannon, for example, calibres of 35 mm and larger, as used in anti-aircraft weapons systems.

Because of these and other deficiencies and disadvantages associated with large and massive receivers of most modern, gas operated automatic cannon, applicant has invented an open-framework receiver, or substantially receiverless, gas operated automatic cannon, which is accordingly much less massive and much less costly and time consuming to manufacture than comparable conventional cannon, and which can be constructed without use of the special equipment and skills required for manufacturing conventional cannon receivers.

In an automatic cannon weapons system having shell feed means, triggering means and cannon mount means, an open-framework receiver cannon, according to the present invention, comprises a cannon barrel having a shell receiving breech end and a barrel box axis, reciprocating bolt means for enabling firing of the cannon and means for supporting the barrel and bolt means in operative relationship with the shell feed means and triggering means.

Included in the supporting means are a breech ring having a breech aperture formed axially therethrough configured for receiving the breech end of the barrel, first and second elongate, rigid support members having forward and rearward ends and intermediate portions therebetween and means for fixing the support member intermediate portions to the breech ring in laterally spaced apart, symmetrical relationship with longitudinal axis of the members parallel to, and coplanar with, the barrel bore axes when the barrel is received in the breech ring. Barrel support means are also included in the supporting means for rigidly interconnecting the member forward ends with the breech ring received barrel, as are means for receiving the bolt means and for guiding reciprocating movement thereof and means for rigidly interconnecting rearward ends of the support means.

More specifically, the means for interconnecting rearward ends of the support members includes buffer means for stopping recoil of the bolt means after firing of the cannon and for imparting counterrecoil to the bolt means immediately thereafter. A buffer and a buffer housing are included in the buffer means, as are means for detachably connecting the buffer housing to the support member rearward ends to provide rigid interconnection thereof. The support members each comprise an elongate, hollow cylinder having an elongate slot extending rearwardly, upon assembly, from the breech ring and facing the barrel bore axis.

The bolt means includes a bolt carrier, a bolt, means for slidably mounting the bolt to the bolt carrier for limited relative axial movement therebetween and locking means mounted to the bolt for causing locking of the bolt to the breech ring during firing of the cannon. Portions of the bolt carrier are configured for interfering with the locking means to prevent unlocking of the bolt from the breech ring when the bolt carrier is at a forwardmost position relative to the bolt, as is the condition at the instant of firing.

Recoil means are provided for causing rearward recoil movement of the bolt carrier, relative to the bolt, in response to firing of the cannon, thereby moving the bolt carrier out of interference with the bolt locking means to enable unlocking of the bolt from the breech ring. Comprising the recoil means are recoil pistons disposed in each of the support members. The recoil pistons include means for engaging opposite side portions of the bolt carrier through the support member slots, the pistons and slots thereby also forming portions of the means for receiving and guiding the bolt assembly during reciprocating movement thereof. Also included in the bolt carrier recoil means is a barrel gas manifold, fixed to the cannon barrel forwardly of the barrel support means, having gas passages aligned with gas apertures formed through the barrel and means responsive, after firing of the cannon, to flow of pressurized barrel gas through the passages, for driving the pistons and the bolt carrier connected thereto rearwardly in recoil.

The barrel gas manifold also includes a feeder gas passage communicating with an aperture through the barrel means for routing pressurized barrel gas from a manifold feeder gas port to a gas operated shell feeder.

To drive the bolt assembly forwardly from a seared up position, drive means disposed in the support members are connected to the recoil pistons and include a pair of elongate coil springs and spring guides extending forwardly from the rearward ends of the support members for substantially the entire length thereof. Forward ends of the springs are in engaging relationship with forward portions of the recoil pistons.

A plate longitudinally extending between the breech ring and the buffer housing, below the barrel bore axis, includes bolt means engaging tracks and an axially elongated ejection port for enabling fired shell casings to be ejected downwardly through the plate.

Compliant mounting of the cannon to cannon mounting means, for limited axial cannon recoil and counterrecoil movement, is provided by first and second rigid, elongate, hollow recoil cylinders disposed around portions of the first and second support members, respectively, between the breech ring and the barrel support means. Such recoil cylinders have outwardly projecting lugs formed symmetrically about the barrel bore axis and coplanar therewith; mounting of the cannon to the cannon mounting means is by fasteners which pass through recesses in these lugs. Axially compressible recoil spring means are disposed between the recoil cylinders and the respective support member cylinders and provide interconnections therebetween, the spring means opposing relative movement between the recoil cylinders and the support members in both axial directions.

The cannon mounting means preferably includes laterally spaced apart, first and second mounting tracks into which the recoil cylinder lugs and corresponding portions of the breech ring, the barrel support means and the buffer are axially slidably received, recoil and counterrecoil movement of the cannon relative to the cannon mounting means being thereby limited to movement along the tracks.

A better understanding of the present invention may be had from a consideration of the following detailed description, taken in conjunction with the accompanying drawings, in which.

Figures 1, 2, 5:
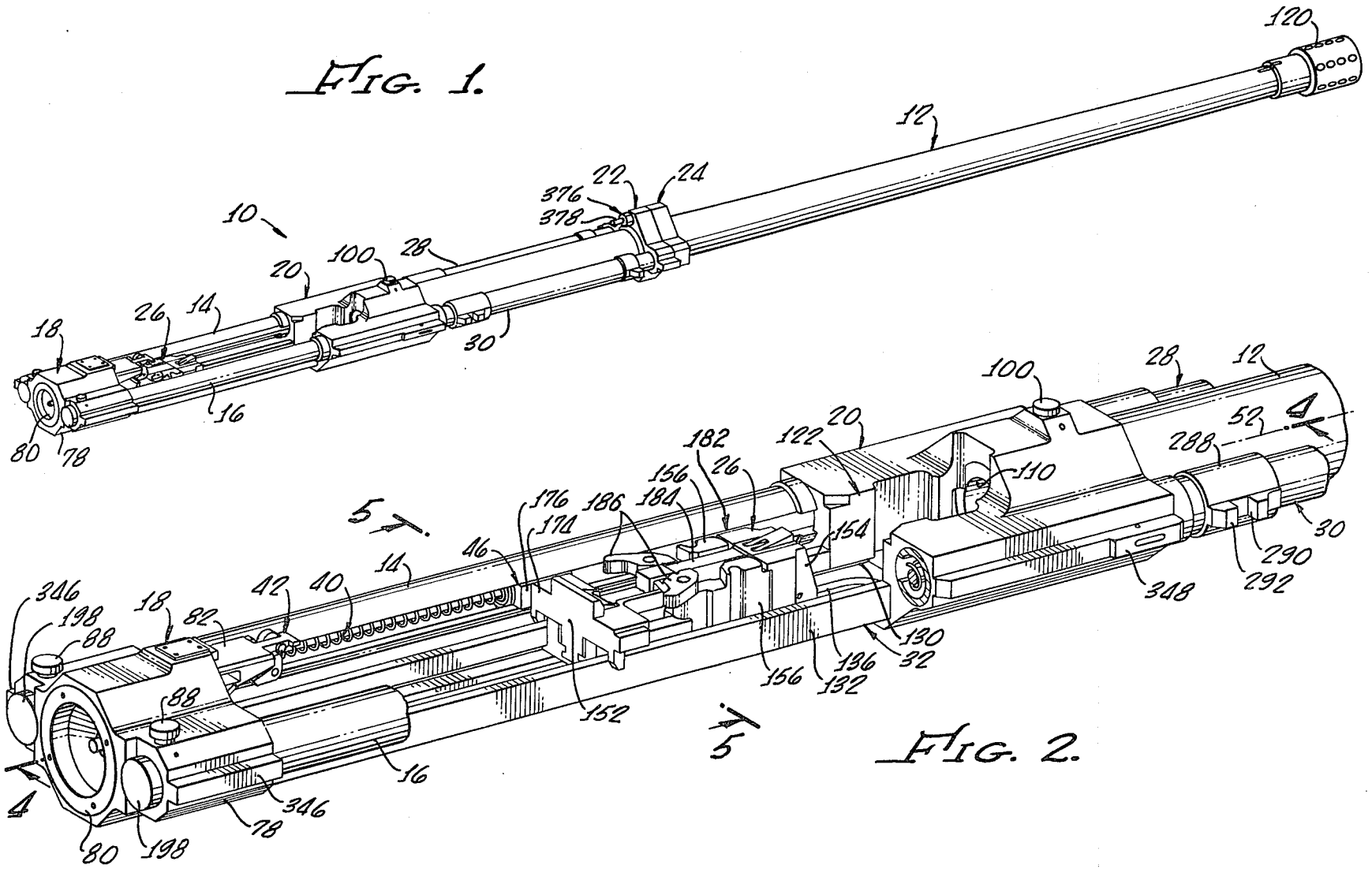
FIG. 1 is a perspective drawing of an open-framework receiver automatic cannon, according to the present invention.
FIG. 2 is a partially cutaway perspective drawing of rearward portions of the open-framework receiver cannon of FIG. 1, showing a pair of support members, a breech ring, a bolt assembly and a recoil buffer.
FIG. 5 is a transverse, vertical sectional view along line 5—5 of FIG. 2, showing means for mounting and guiding the bolt assembly.

Seen assembled in FIGS. 1 and 2, is an open-framework receiver, gas operated cannon 10 according to the present invention. Because of the open configuration of rearward cannon portions, as compared to corresponding closed receivers of conventional gas operated cannon, the cannon 10 may be considered to be a "receiverless" cannon, the below described relatively light weight but rigid open-framework taking the place of a conventional massive receiver.

In general, the cannon 10 comprises a barrel 12, first and second elongated rigid tubular support members 14 and 16, respectively, a recoil buffer assembly 18, a breech ring 20 and a forward barrel support assembly 22. Also included are a barrel mounted gas manifold assembly 24, a reciprocating bolt means or assembly 26, first and second cannon recoil and mounting assemblies 28 and 30, respectively, and a generally rectangular bottom plate 32.

As more particularly described below, intermediate portions of the support members 14 and 16 are fixed to the breech ring 20 which receives a breech or firing chamber end of the barrel 12. Forward ends of the support members 14 and 16 are interconnected with one another and the barrel 12 by the barrel support 22. The buffer assembly 18 rigidly interconnects rearward ends of the support members 14 and 16.

Mounting of the bolt assembly 26, and guiding thereof in recoil and counterrecoil travel between the breech ring 20 and the recoil buffer 18, is provided by the support members 14 and 16 and the bottom plate 32. Means, described below, are disposed within the support members 14 and 16 for causing recoil of portions of the bolt assembly 26 after firing of the cannon. Also disposed internally of the support members 14 and 16 are drive means 40 for driving the bolt assembly 26 forwardly upon release from sear means 42 connected to the buffer 18, in response to conventional triggering means (not shown) associated with a weapons system (also not shown) with which the cannon 10 is used.

Figure 3:
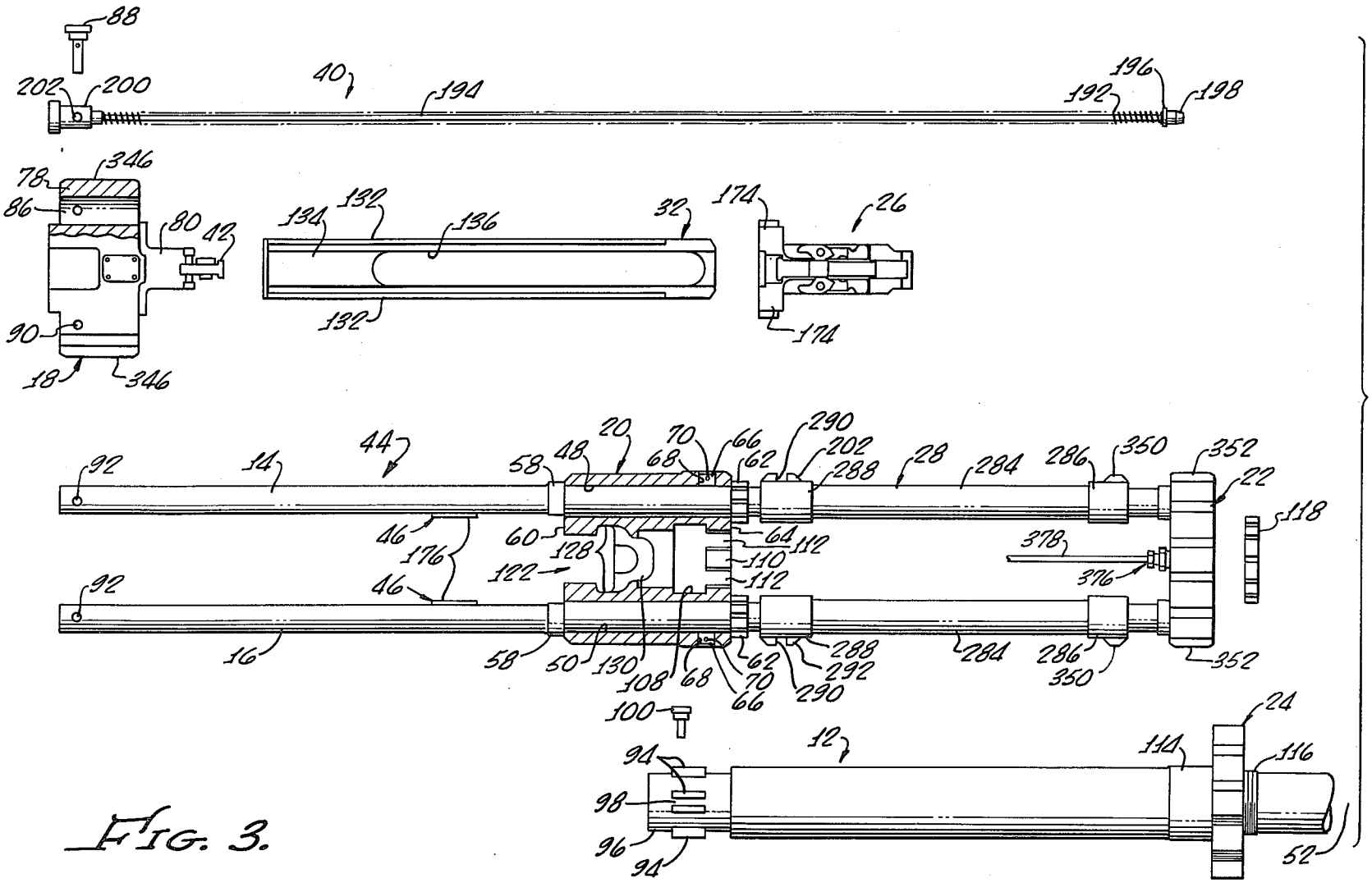
FIG. 3 is a plan view showing major portions of the open-framework receiver cannon of FIG. 1 in exploded form.

More particularly, as seen in the exploded drawing of FIG. 3, a symmetrical, rigid open-framework assembly 44, which may also be considered as a breech ring assembly, includes the breech ring 20, the first and second support members 14 and 16 and the forward barrel support 22. Included in the framework assembly 44 are the first and second cannon recoil and mounting assemblies 28 and 30, which are disposed around corresponding ones of the support members 14 and 16 between the breech ring 20 and the barrel support 22. Also included are bolt carrier recoil means 46, only bolt assembly engaging portions of which are visable in FIG. 3, mounted within each of the support members 14 and 16.

In order to accommodate the bolt assembly drive means 40 and the recoil means 46, the support members 14 andd 16 are formed as long hollow, preferably steel, cylinders. As an illustration, for a 35 mm cannon, the members 14 and 16 may be about 5½ feet long and 1 11/16 inches nominal outside diameter. Construction of the support members 14 and 16 is thus comparatively simple without requiring complex machinery or a high degree of skill. For example, the support members 14 and 16 can readily be fabricated on the same type of conventional barrel turning machinery used for making the barrel 12.

Fixing of the support members 14 and 16 to the breech ring 20 is by laterally spaced apart, first and second apertures 48 and 50 formed longitudinally through opposite sides of the breech ring and into which intermediate portions of the support members are received. The apertures 48 and 50 are oriented so that when the support members 14 and 16 are installed therethrough, longitudinal axis of the members are parallel to, and spaced symmetrically to opposite sides of, a longitudinal framework assembly axis which coincides, on assembly, with a barrel bore axis 52. In addition, and importantly, the breech ring apertures 48 and 50 are positioned so that, longitudinal axes of the received support members 14 and 16 are coplanar with the barrel bore axis 52.

Because longitudinal axes of the support members 14 and 16 are located symmetrically about, and coplanar with, the barrel bore axis 52, loads on the assembled cannon 10, for example, firing reaction forces through the recoil and mounting assemblies 28 and 30 and bolt carrier recoil forces caused by the recoil means 46, are symmetrically applied to the cannon and are in the plane of the bore axis 52. As a result, offset or eccentric loading on the cannon 10, which could cause whipping of the barrel 12, is virtually non-existant. Projectile dispersion during firing is thus very small, making the cannon 10 highly accurate, as is very important in critical weapons systems, such as anti-aircraft gun systems.

Because of this symmetry about a vertical plane through the bore axis 52, generally only one side of the cannon 10 is described herein, symmetrical and mirror image features and elements being given identical reference numbers. An exception is made to this practice where separate identification of symmetrical or mirror image features or elements is provided to enable clearer description of the invention.

Typical of the members 14 and 16, the first support member 14 is axially retained in the breech ring aperture 48 by a generally annular ring or boss 58 formed around the outside of the member (except for bore axis facing regions), the boss forwardly abutting a breech ring rear face 60. A cooperating nut 62, when threaded onto a corresponding exteriorally threaded portion (not shown in FIG. 3) of the member 14, rearwardly abuts a breech ring forward face 64.

Predetermined rotational orientation of the support member 14 in the breech ring aperture 48, is provided by a breech ring mounted key 66 partially received into a corresponding support member slot 68. A pin 70 is used to retain the key 66 in such installed position. The second support member 16 is retained in the corresponding breech ring aperture 50 in an identical manner.

Rearward ends of the support members 14 and 16 are rigidly interconnected by the buffer assembly 18, which includes a structural buffer housing 78 within which is disposed a buffer 80 (FIG. 2). For the particular type of buffer assembly 18 illustrated, the sear means 42 is pivotally mounted to a forwardly projecting buffer portion 82, so the buffer assembly also functions as a sear buffer. That is, the buffer assembly 18 performs a first function of stopping recoil of the bolt assembly 26 and imparting counter-recoil thereto after firing of the cannon 10 and a second function of buffering or softening searing up of the bolt assembly when firing is interrupted.

To perform these dual functions, the buffer 80 may utilize mechanical springs to absorb and release recoil and searing kinetic energy and may be of generally conventional mechanical construction. Alternatively, the entire buffer assembly 18 may be of the gas "spring" type described in copending U.S. patent application Ser. No. 024,185, filed on even date herewith.

Releasable connection of the buffer assembly 18 to rearward ends of the support members 14 and 16 is enabled by a two support member receiving apertures 86 (only one of which is shown) formed through opposite sides of the housing 78, parallel to, and in a common plane with, the bore axes 52. After installation onto the support members 14 and 16, the buffer assembly 18 is retained thereon by two locking pins 88 (FIG. 2) installed downwardly through pin apertures 90 (positioned to intersect the longitudinal housing apertures 86) into corresponding apertures 92 formed through the support members 14 and 16. Spring loaded detent means (not shown) releasably retain the pins 88 in the apertures 90 and 92.

However, prior to installing the buffer assembly 18 onto the support members 14 and 16 in such manner, the bottom plate 32 and bolt assembly 26 are installed, as described below. Interconnection of forward ends of the members 14 and 16, by the barrel support 22, is also described below, in conjunction with description of the recoil and mounting means 28 and 30.

Formed in a generally conventional manner, the barrel 12, to which the gas manifold 24 is fixed, includes several (for example, five) circumferentially spaced apart breech ring mounting lugs 94 which outwardly project from a breech end portion 96. An uppermost one of the mounting lugs 94 is formed having an axially extending detent slot 98 enabling rotational locking of the barrel 12 to the breech ring 20 by a detent pin 100 (FIG. 2).

To receive the barrel 12, the breech ring 20 is formed having an axial aperture 108, around forward regions of which are a plurality of inwardly projecting lugs 110 corresponding to the barrel lugs 94, width of spacings or slots 112 between the breech ring lugs being slightly greater than width of the barrel lugs. To mount the barrel 12 to the breech ring 20, the barrel is oriented with the barrel lugs 94 aligned with the slots 112. Then, the barrel 12 is pushed rearwardly and rotated to position the barrel lugs 94 directly rearwardly of the breech ring lugs 110, subsequent direct forward removal of the barrel from the breech ring being prevented by interference between the lugs and by the detent pin 100 which prevents turning the barrel to realign the lugs 94 with the slots 112.

Alternatively, connection of the barrel 12 to the breech ring 20 may be by conventional interrupted threads (not shown) formed on the barrel and in the breech ring.

An annular boss or enlarged diameter region 114 is formed on the barrel 12 immediately rearwardly of the gas manifold position for mounting of the barrel support 22. Forwardly of the gas manifold position, the outside of the barrel 12 is threaded, in a region 116, for receiving a large threaded retaining ring 118. Detachably connected to the muzzle end of the barrel 12 is a muzzle brake 120 (FIG. 1), which may be of conventional configuration.

An open rearward region 122 of the breech ring 20 is configured for receiving forward portions of the bolt assembly 26 when the bolt assembly is in a forwardmost, battery position. Breech ring side recesses 128 enable locking of the bolt assembly 26 to the breech ring 20 during firing of the cannon 10, as described below. A lower portion 130 of the breech ring region 122 is configured for receiving forward end portions of the plate 32 (FIG. 4) which provides lower support and axial guiding of the bolt assembly 26.

Figure 4:
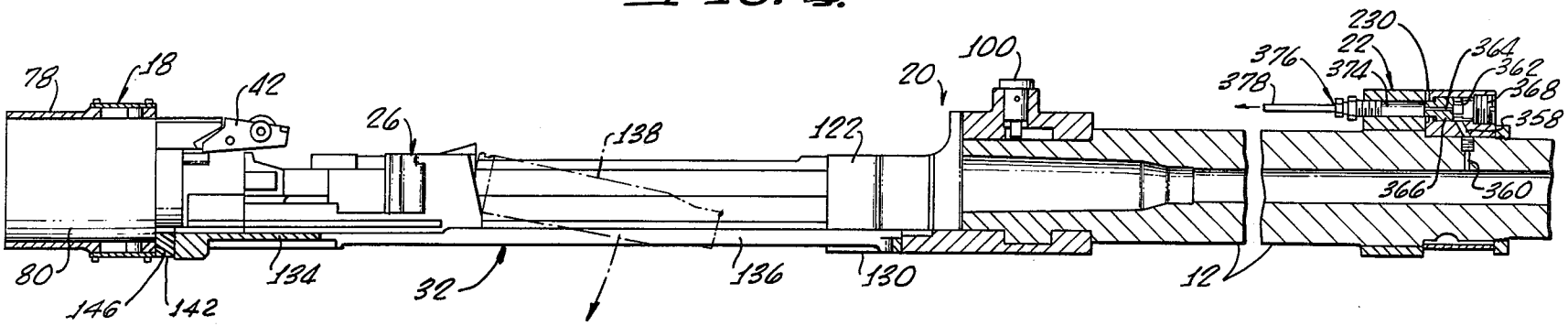
FIG. 4 is a longitudinal, vertical sectional view along line 4—4 of FIG. 2, showing features of the open-framework receiver cannon.

Elongate bolt assembly guide recesses or tracks 130 (FIG. 5) are formed longitudinally along raised sides 132 of the plate 32. In a flat, transverse bottom portion 134 of the plate 32, an axially elongated port 136 is formed, through which casings 138 of fired shells are automatically ejected (FIG. 4) during operation. As also seen in FIG. 4, a depending rearward end portion 142 of the bottom plate 32 is configured for abutting a mating portion 146 which projects slightly forwardly, in plate engaging relationship, from the buffer housing 78.

Figure 7A:
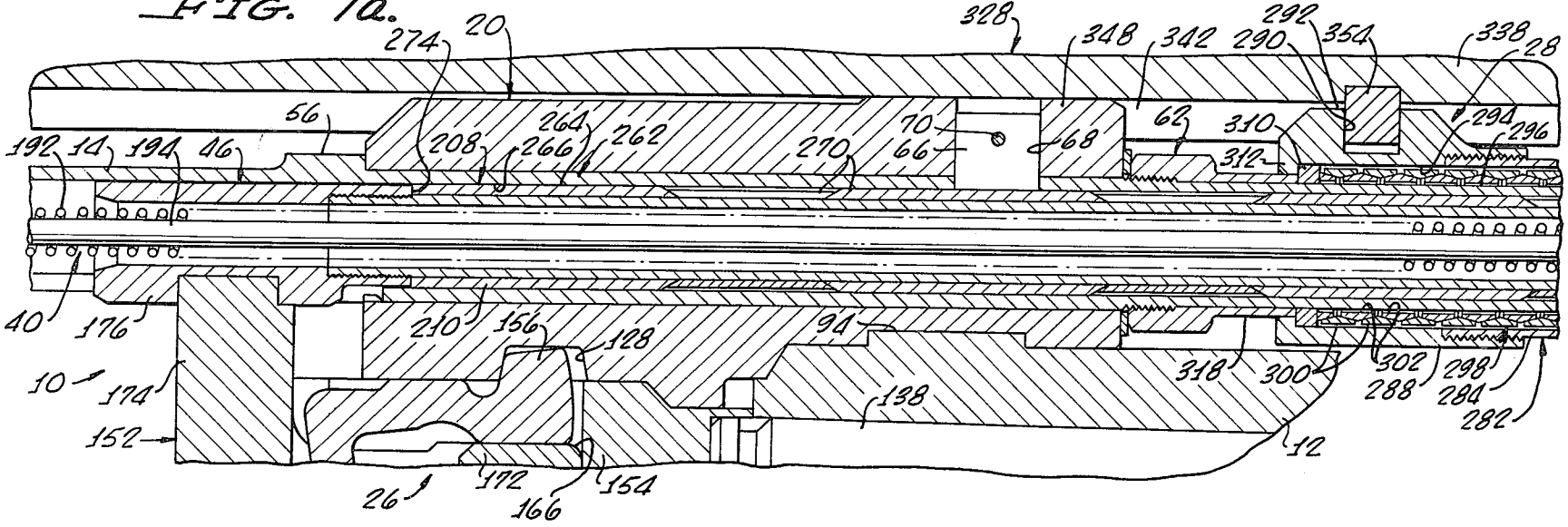
FIG. 7 is a partial horizontal section view, generally along line 7—7 of FIG. 1, FIG. 7(*a*) showing portions of the breech ring and intermediate portions of the support members, and FIG. 7(*b*) showing forward ends of the support members and interconnection thereof.

Particular configuration of the bolt assembly 26 may vary according to specific requirements of the cannon 10. For illustrative purposes, however, the bolt assembly 26 is shown and described as the type disclosed in U.S. patent application, Ser. No. 024,188, filed on even date herewith. As such, the bolt assembly 26 comprises a generally T-shaped bolt carrier 152, an L-shaped bolt 154 and two opposing bolt locking lugs 156 having rearward ends pivotally mounted to the bolt (FIG. 7*a*).

An inverted, T-shaped projection 158 (FIG. 5) formed longitudinally along bottom portions of the bolt carrier 152, and a mating slot 160 formed in rearward portions of the bolt 154, enable mounting of the bolt and bolt carrier together for limited axial sliding movement therebetween. Outwardly projecting lugs 162 on opposite, lower sides of the bolt 154 engage, on assembly, the bottom plate tracks 130, thereby constraining the bolt assembly 26 to the plate 32 while guiding bolt assembly recoil and counterrecoil movement between the breech ring 20 and the buffer assembly 18.

Opposing inner surfaces 164 of the bottom plate sides 132 keep the locking lugs 156 in a retracted condition unless the bolt assembly 26 is forward at the breech ring 20, at which position the bottom plate sides terminate. During firing, when the bolt assembly 26 reaches the breech ring 20, a nose portion 166 (FIG. 7*a*) of the bolt carrier 152 causes the locking lugs 156 mounted on the stopped bolt 154 to pivot outwardly into locking engagement with the breech ring recesses 128 in a generally conventional manner. Then, as bolt carrier forward movement continues to cause firing of a chambered shell by a bolt carrier mounted firing pin (not shown), an interfering bolt carrier portion 172 slides between the extended locking lugs 156 to prevent their retracting from the breech ring recesses 128.

After firing, the bolt carrier 152 is rearwardly recoiled relative to the bolt 154, by the recoil means 46, out of interference with the locking lugs 156 to enable bolt unlocking and recoil. Sidewardly projecting bolt carrier arms 174 mechanically engage corresponding bolt carrier connecting portions 176 of the recoil means 46 (FIG. 5), through elongate, inwardly facing slots 178 in the members 14 and 16 rearwardly of the breech ring 20, to enable such bolt carrier recoiling after firing, as more particularly described below.

Included on each of the bolt carrier arms 174 is a depending lug 180 positioned for engagement by externally mounted charger means (not shown) which enable the cannon 10 to be charged for firing.

Other features of the bolt assembly 26 include shell casing ejection means 182 (FIG. 2) which may be of conventional configuration. However for the particular type of bolt assembly illustrated the ejection means are of the cam actuated, "programmed" type described in U.S. patent application Ser. No. 024,184 filed on even date herewith. Thus, for example, the ejection means 182 includes an ejector bar 184 and two actuating elements or cam followers 186 pivotally mounted atop the locking lugs 156, and which cooperate with a pair of cam tracks (not shown) fixed to portions of structure adjacent the mounted cannon 10 to cause forward movement of the bar 184 relative to the bolt assembly 26, and hence ejection of the casing 138, through the plate opening 136 on recoil after firing (FIG. 4).

Figure 6:
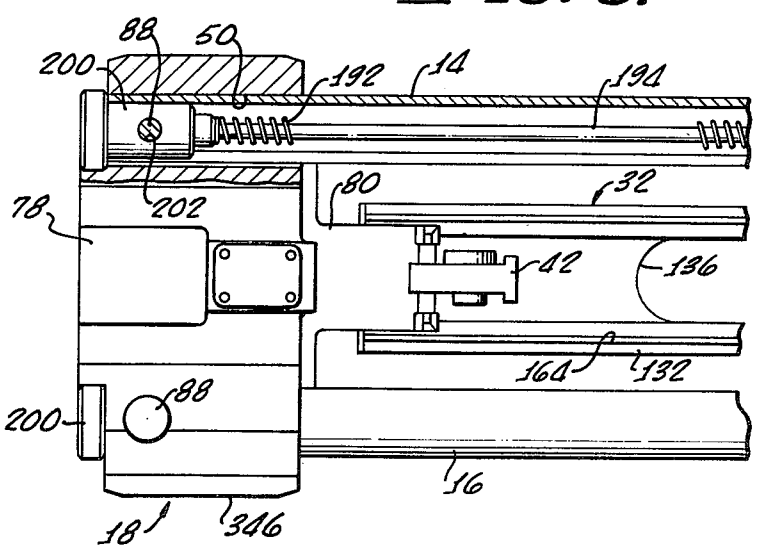
FIG. 6 is a partial horizontal sectional view, showing rearward portions of the open-framework receiver cannon.
Figure 5:
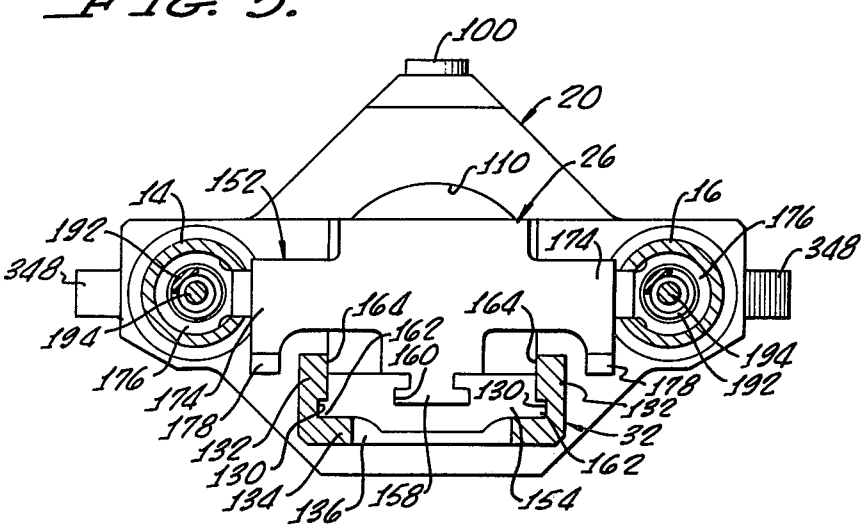

Forward driving of the bolt carrier 152, and consequently the entire bolt assembly 26, upon release from the sear means 42 (by associated triggering or control means, not shown) is by the drive means 40. Cooperating with the recoil means 46, as described below, the drive means 40 includes, for mounting in each of the support numbers 14 and 16, an elongated coil spring 192 (FIGS. 3, 6 and 7) of single or multistrand construction. Installed internally of each spring 192 is an elongated spring retaining and guide rod 194 having a forwardly mounted spring retainer 196 and forward guide 198, and a rearward retainer 200. Formed transversely through each of the retainers 200 is an aperture 202, through which one of the buffer locking pins 88 extends upon assembly.

Figure 7B:
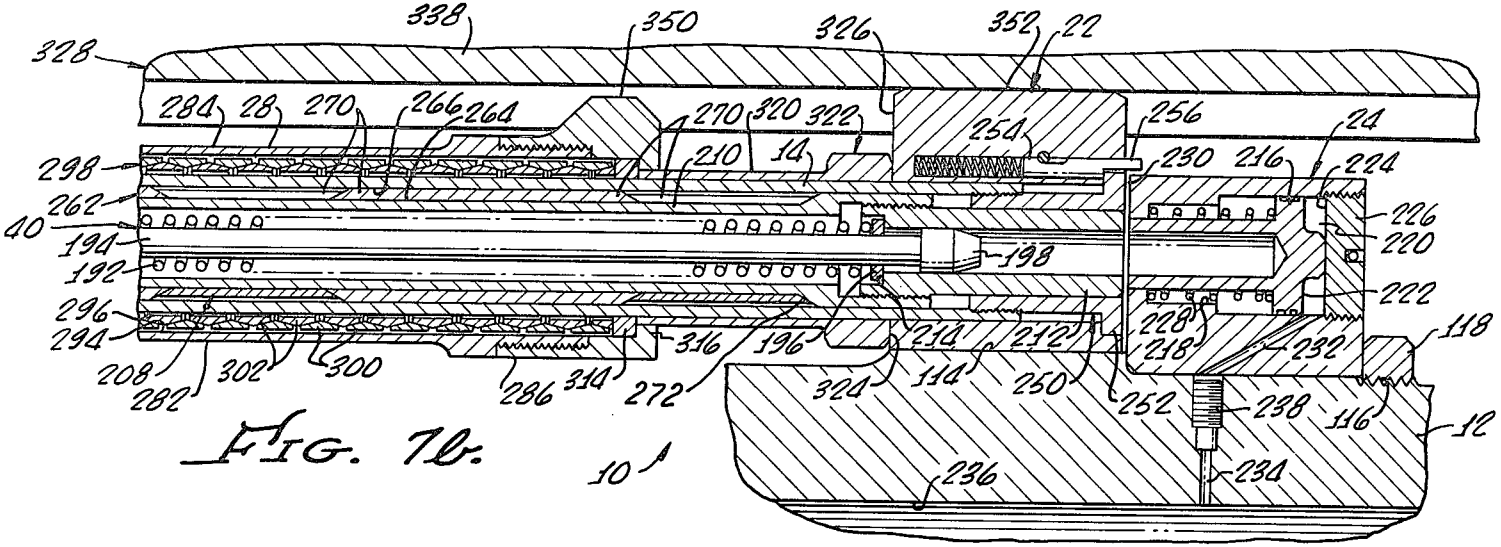

As best seen in FIGS. 7(*a*) and 7(*b*), the bolt carrier recoil means 46 includes a long, tubular recoil piston assembly 208 through the inside of which forward regions of the drive means 40 are received. Included in the piston assembly 208 is a central, tubular piston member 210 to a rearward end of which is threaded the bolt carrier connecting portion 176 and to a forward end of which is threaded a short tubular drive member 212.

Abutting a rearward face 214 of the drive member 212 is the spring retainer 196, through which forward regions of the spring guide rod 194 extends into the inside of the drive member. As a consequence, rearward movement of the piston assembly 208, to recoil the bolt carrier 152, and as the bolt assembly 26 recoils, also causes compressing of the drive spring 192 to enable subsequent driving of the bolt assembly 26 forwardly upon unsearing. During automatic firing, most of the forward bolt assembly drive is, however, provided by the buffer 80 and not by the springs 192.

Rearward driving of the piston assembly 208 is caused by a short piston 216 (FIG. 7(*b*)) which is axially slidably mounted in a gas manifold aperture 218 in axial alignment with the piston assembly drive member 212. Within the gas manifold aperture 218, a small barrel gas chamber 220 is formed between a forward face 222 of the piston 216 and a rearward face 224 of a piston retaining nut 226 threaded into the aperture.

A spring 228 urges the piston 216 forwardly in the aperture 218. However, a spacer (not shown) limits forward piston travel to maintain a minimum volume in the chamber 220. Because of such forward piston biasing, a small gap 230 is maintained between the barrel support 22 and the gas manifold 24 to enable rotational barrel movement for assembly and disassembly.

A first gas passage 232, formed generally radially through the gas manifold 24, interconnects the gas chamber 220 with a second gas passage 234 formed radially through the barrel 12 from an inner surface 236. Flow of pressurized barrel gas into the gas chamber 220, through the passages 232 and 234, to vary bolt assembly recoil velocity, can be regulated by an orifice or other flow control means 238 installed in the second passage 234.

From FIG. 7(*b*), it is apparent that when the cannon 10 is fired, pressurized gas from the barrel 12, flows through the passages 234 and 232 into the chamber 220. Rapid buildup of gas pressure in the chamber 220 drives the piston 216 rearwardly into impact with the piston assembly 208, to thereby cause rearward moving of the bolt carrier interfering portions 172 out of interference with retracting of the locking lugs 156 from the breech block recesses 128. When the lugs 156 are free to retract, barrel gas pressure acting on the bolt 154 through a still-chambered shell casing, causes the lugs to retract and drives the bolt, and thus the entire bolt assembly 26, rearwardly at high recoil velocity.

As can be seen in FIG. 7(*b*), forward portions of the piston assembly drive member 212 are slidingly disposed in a sleeve 250 installed in the barrel support 22 and threaded to a forward end of the support member 14. A flange 252 formed along the outside of the sleeve 250 prevents rearward sleeve movement. A detent pin 254, for engaging one of a number of slots (not shown) in the sleeve flange 250, is positioned in the barrel support 22 just outwardly of the sleeve 250. Rearwardly pushing on a forwardly projecting detent pin portion 256 releases the sleeve 250 for disassembly.

Inertia weight means 262 (FIG. 7) may also be installed in the support member 14 (as well as separately in the member 16), between a piston assembly outer surface 264 and a support member inner surface 266, to prevent or reduce rearward bouncing of the bolt carrier 152 on impact thereof against the breech ring 20 at the instant of shell firing. If such bouncing is permitted, premature bolt unlocking may occur as a result of the bolt carrier interfering portion 172 being partially or entirely moved out of interference with retraction of the locking lugs 156.

Included in the anti-bounce means 262, as illustrated, is a number of short inertia weights 270. Axial movement of the weights 270, which may be of the split collet type disclosed in U.S. patent application Ser. No. 024,188, filed on even date herewith, is limited by forward and rearward faces 272 and 274, respectively, of the bolt carrier connecting portion 176 and forward portions of the piston member 210, limited axial movement of the weights 270 being permitted.

When the bolt carrier 152 impacts against the breech ring 20, thereby stopping forward travel of the connected piston assembly 208, the weights 270 impact forwardly against one another in a manner to keep driving the bolt carrier 152 forwardly to prevent rearward bouncing thereof.

In the particular configuration shown, alternate ones of weights 270 are axially split to enable radial expansion thereof into frictional locking engagement with the support member inner wall 266, in response to inwardly tapered ends of the split weights ramping up over oppositely tapered ends of forwardly adjacent weights. This locking relationship temporarily and instantaneously locks the piston assembly 208, and hence the bolt carrier 152, to the support member 14 to further help prevent bolt carrier bouncing.

Recoil mounting of the cannon 10, is enabled by the first and second recoil and mounting means 28 and 30. Shown particularly in FIGS. 7(*a*) and 7(*b*), the first such means 28, are mounted about the first support member 14 between the breech ring 20 and the barrel support 22. Included in the first means 28 is a recoil cylinder assembly 282 comprising an elongated, tubular body portion 284, to ends of which are threaded forward and rearward end members 286 and 288, respectively. An outwardly opening, mounting pin recess or slot 290 is found in a lug portion 292 of the rearward end member 288 at about the cannon center of gravity.

Confined between a continuous inner surface 294 of the cylinder assembly 282 and the end members 286 and 288 and beneath adjacent outer surface portion 296 of the support member 14, are recoil compression spring means 298. To limit recoil of the cannon 10 to a relatively short distance, for example, in the approximate range of one to one and a half inches for a 35 mm cannon, the spring means 298 is preferably comprised of a relatively large number of conventional outer and inner ring springs 300 and 302.

By way of illustration, the springs 300 and 302 may comprise, respectively, for a 35 mm cannon, type 1206 outer and inner ring springs manufactured by the Ringfeder Corporation, the outer rings being approximately 2 inches in diameter. The ring springs 300 and 302 are arranged in alternating order so that, in response to compressional forces on the spring means 298, caused by firing of the cannon 10, the outer springs 300 are forced to radially expand due to wedging action against the intermediate, inner ring springs 302, spring action being thereby provided.

To enable compression, the spring means 298 are axially confined to the region of the recoil of the recoil cylinder assembly 282. Accordingly, at a rearward end, confinement of the spring means 298 is by a rear retaining ring 310 which rearwardly abuts an inwardly directed annular flange 312 of the rearward end member 288. Similarly, the spring means 298 are confined at a forward end by a forward retaining ring 314 which forwardly abuts an inwardly directed forward end member flange 316.

According to required recoil characteristics, the end members 286 and 288 may be threadably adjusted on the body portion 284 to provide a selected compressional preloading of the ring springs 300 and 302. Furthermore, spring characteristics of the spring means 298 can be easily varied by adding or removing individual springs 300 or 302, the end members 286 and 288 being threaded onto the body portion 284 to correspondingly vary overall length of the cylinder assembly 282 over a limited range.

Compression of the spring means 298 in both axial directions, by relative axial movement between the recoil cylinder assembly 282 and the support member 14, is enabled. At a rearward end, a forwardly extending, tubular portion 318 of the nut 62, which is fixed to the support member and which axially retains the support member in the breech ring 80, extends forwardly through the rear end member flange 312 into abuttment with the rear spring retainer ring 310. Similarly, at a forward end, a rearwardly extending tubular portion 320 of a forward retaining member 322 extends rearwardly through the forward end member flange 316 into engagement with the forward spring retainer ring 314. A forward surface 324 of this forward retaining member 322 abuts a rearward face 326 of the barrel support 22.

Under static conditions, with the spring means 298 uncompressed (except for any preloading), the nut forward portion 318 and the rearwardly extending, forward retaining member portion 320 abut, respectively, the rearward and forward retaining rings 310 and 314, which in turn abut adjacent ends of the spring means 298.

Figure 8:
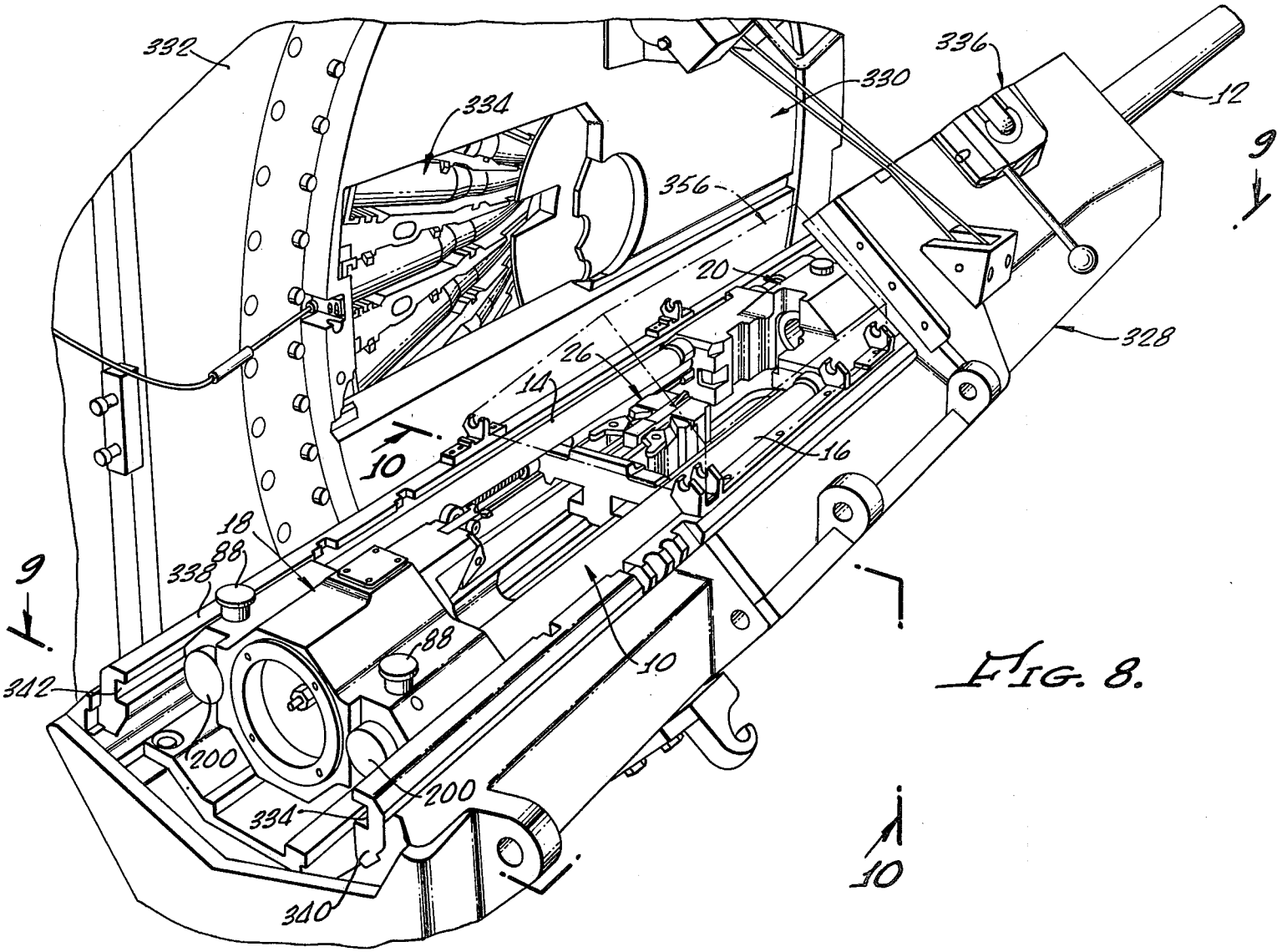
FIG. 8 is a perspective drawing, showing, by way of example, means for mounting the open-framework receiver cannon to a cannon mounting cradle associated with a weapons system.
Figure 9:
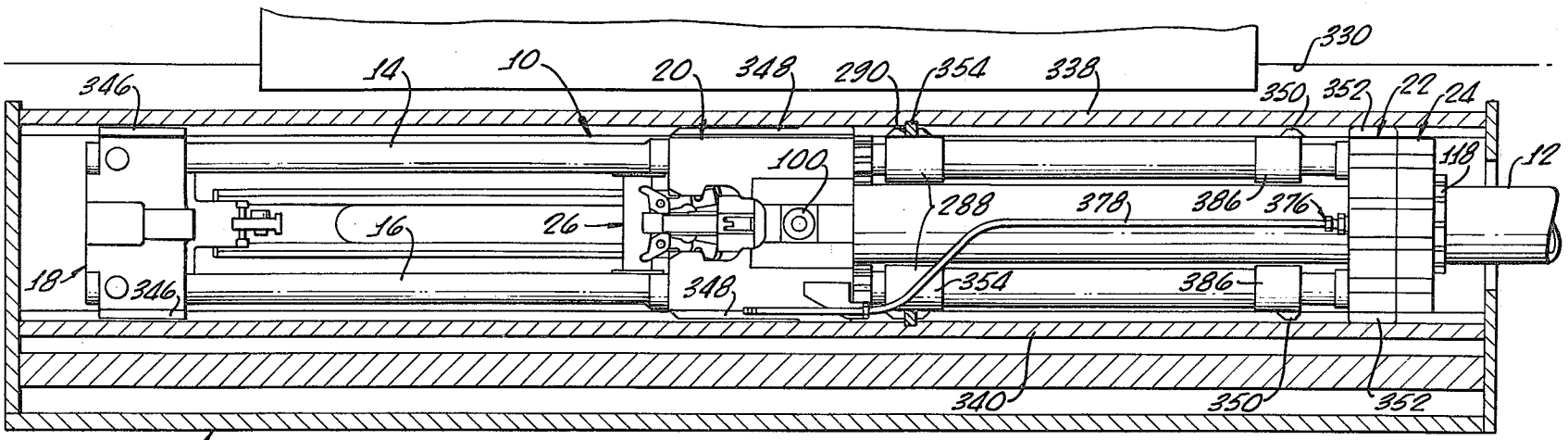
FIG. 9 is a horizontal sectional view along line 9—9 of FIG. 8, showing releasable mounting of the cannon to the mounting cradle.
Figure 10:
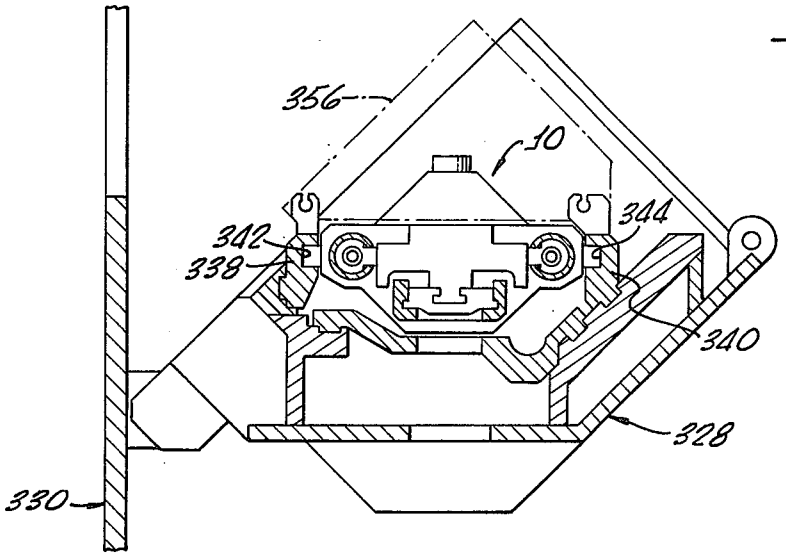
FIG. 10 is a vertical sectional view along line 10—10 of FIG. 8, showing slidable mounting of the cannon in the cradle.

For illustration purposes, the assembled cannon 10 is shown in FIGS. 8–10 mounted in a cannon cradle or cannon mounting means 328 of the type disclosed in U.S. patent application Ser. No. 122,661 filed on Feb. 19, 1980. The cradle 328 is hingeably attached, for cannon access purposes, to a large circular side plate 330 rotatably mounted, for cannon elevational movement, to an associated air defense weapons system cupola or turret 332. In FIGS. 8–10, the cradle 328 is seen in an open, downwardly hinged, condition. For firing, the cradle 328 is pivoted upwardly (not shown) to bring the cannon 10 into feeding proximity to a shell supply system 334 (FIG. 8) and is locked in such position by latch means 336.

To receive the cannon 10, first and second, laterally spaced apart, longitudinal tracks or rails 338 and 340 are rigidly fixed within the cradle 328. Formed along the tracks 338 and 340 are longitudinal cannon receiving slots 342 and 344, respectively, rearward ends of which are open to permit forward installation of the cannon 10 thereinto. Support means (not shown) disposed in the cradle 328 intermediate the tracks 338 and 340 may be provided for supporting the bottom plate 32.

To constrain the cannon 10 to axial sliding movement along the tracks 338 and 340, the cannon is constructed having several longitudinally spaced apart transverse pairs of side mounting lugs which are received into the mounting track slots 342 and 344. As seen, for example in FIGS. 1–3, these several pairs of lugs include lugs 346 formed along opposite side edges of the buffer housing 78, lugs 348 similarly formed along sides of the breech ring 20, the lugs 292 on the recoil cylinder assembly rearward end members 288 and similar lugs 350 formed on the forward end members as well as lugs 252 formed along opposite sides of the barrel support 22.

When the cannon 10 is installed in the tracks 338 and 340 with the lugs 346, 348, 292, 350 and 352 received into the track slots 342 and 344, cannon retaining pins 354 (FIG. 9) are installed downwardly through the tracks and the recoil cylinder assembly rearward end member slots 290. Mounting to the cradle 328 in this manner rigidly, yet relatively simply, supports the cannon 10 along appreciable portions of the length thereof and thus effectively restrains the cannon against torsional or twisting movement. Assuming the cannon 10 is slidably mounted in the cradle tracks 338 and 340, the retaining pins 354 installed in the cannon lug recesses 290 non-movably fix the recoil and mounting means 28 and 30 to the tracks. However, recoil and counterrecoil movement along the tracks 338 and 340 of remaining portions of the cannon 10 is permitted by the resiliency or compliance of the recoil spring means 298 associated with each of the recoil and mounting means 28 and 30.

Figure 11A:
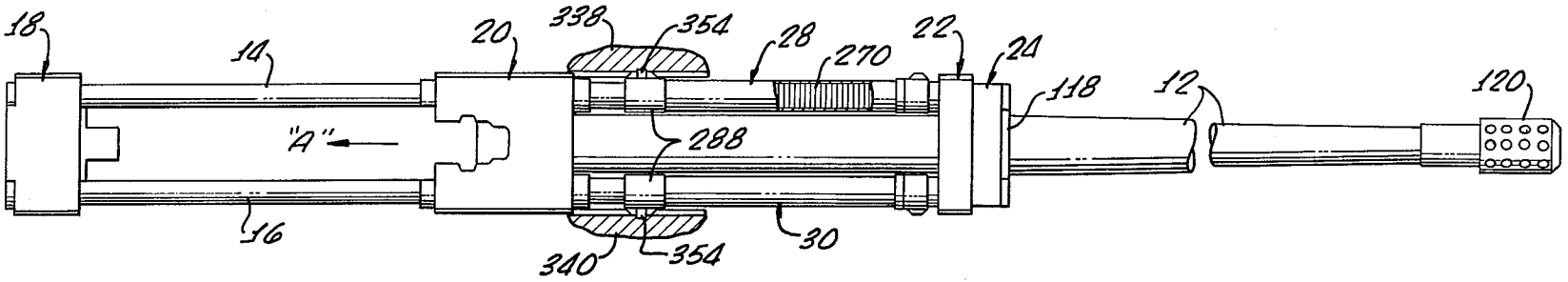
FIG. 11 is a horizontal sectional view similar to FIG. 7, FIG. 11(*a*) showing, after firing, full recoil of the cannon relative to the cannon mount, and FIG. 11(*b*) showing subsequent full counterrecoil of the cannon relative to the cannon mount.
Figure 11B:
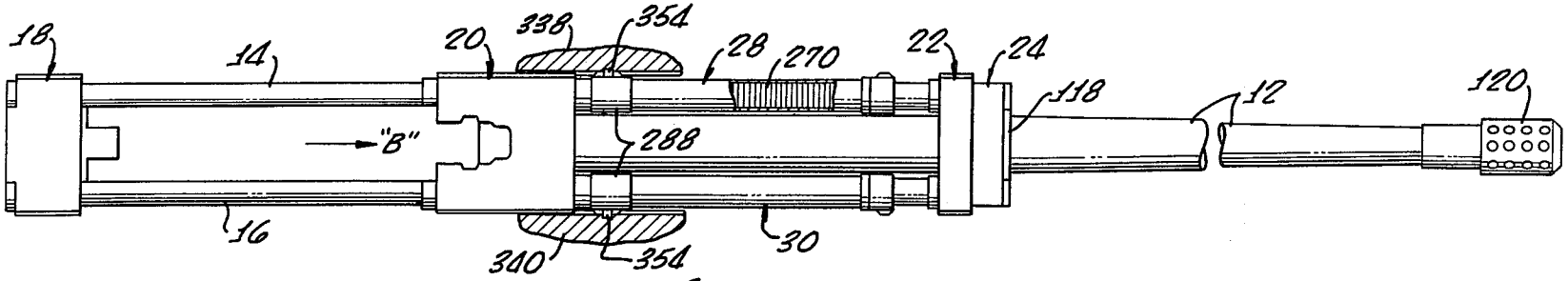

FIG. 11(*a*) illustrates the cannon 10, exclusive of the two recoil cylinder assemblies 282, in full recoil after firing. As can be seen, rearwardly directed firing recoil forces, through the breech ring 20, drive the cannon 10 rearwardly (direction of arrow "A") relative to the recoil cylinder assemblies 282 which are fixed to the cradle tracks 338 and 340 by the pins 354.

Referring to FIGS. 7(*a*) and 7(*b*), it is apparent that such rearward, recoil movement of the support members 14 and 16, with the breech ring 20, the buffer assembly 18, the barrel 12 and the barrel support 22, causes the rearward portions 320 of the retainer members 322 to extend further rearwardly into the recoil cylinder assemblies 282 to compress, through the forward retainer ring 314, the spring means 298. Rearward movement of the spring means 298 is prevented by the rear retainer ring 310 confined by the rear end member flange 312.

When cannon recoil energy is completely transferred to the spring means 298 and cannon recoil is stopped, the ring springs 300 and 302 immediately reexpand to drive the cannon 10 (except for the recoil cylinder assemblies 282) back forwardly in counterrecoil. Full counterrecoil of the cannon 10 is illustrated in FIG. 11(*b*). In this condition the forward portion 318 of the nut 62, (referring to FIGS. 7(*a*) and 7(*b*)) acting on the rear spring retainer 310 again causes compression of the spring means 298, forward spring movement being limited by the forward spring retainer 314 which abuts the forward end member flange 316.

After full counterrecoil, the spring means 298 drive the cannon 10 back rearwardly in secondary recoil. Design of the spring means 298, in conjunction with that of the muzzle brake 120, is such that recoil and counter recoil movement is rapidly damped out, preferably at such a rate that axial movement of the cannon 10 is stopped between individual shots of a burst, even at firing rates as high as 600 rounds per minute.

As is also evident from FIGS. 7(*a*) and 7(*b*), constraining the forward and rearward end members 286 and 288, respectively, of the recoil cylinder assembly 282, by mounting the lugs 292 and 350 in the slots 342 and 344 maintains the initial relative threaded positions of the end members on the body 284. Thus, spring characteristics of the recoil spring means 298 are maintained, as initially adjusted, during operation of the cannon 10.

It is to be appreciated that other portions of an associated weapons system, particularly those directly related to the cannon 10, may also be mounted in or to the cradle 328. Mounted in operative relationship to the cannon 10 in the cradle 328 may, for example, be generally conventional triggering and charging means, not shown because they form no part of the present invention which relates specifically to the cannon 10. Also to be appreciated is that the cannon 10 is adapted for mounting in other types of cannon cradles or mounting means, according to the intended use, the particular cradle 328 being shown merely for illustrative purposes.

In regard to the above mentioned shell supply means 334, open regions in the cannon 10 above the reciprocating path of the bolt assembly 26 importantly provide access by shell feeder means 356 (shown in phantom lines in FIG. 8) to the bolt assembly 26. Such access enables the bolt assembly 26, on travel towards the breech block 20, to pick up an unfired shell from the shell feeder means 356 for loading and firing. The feeder means 356, which also forms no part of the present invention, may, for example, be of the type disclosed in U.S. patent application, Ser. No. 089,308, filed on Oct. 30, 1979.

Assuming, for illustrative purposes, the associated shell feeder means 356 is operated by high pressure barrel gas caused by firing of the cannon 10, an additional gas passage or port 358 (FIG. 4), similar to the passage 232, is formed through upper regions of the gas manifold 24 in a vertical plane of symmetry. Inner end regions of the passage 358 communicate with the inside of the barrel 12 through an aligned barrel side wall aperture or passage 360.

An outer end of the gas manifold passage 358 communicates with an axial gas manifold aperture 362, formed parallel to the barrel bore axis. Disposed in the aperture 362 is a piston 364 which is similar to the piston 216 except for having an axial bore 366. The piston 364 is forwardly retained in the aperture 362 by a nut 368, which seals the forward end of the aperture. An aperture 374 is formed through the barrel support 22 in alignment with the piston axial bore 366. Connected with rearward regions of the barrel support aperture 374 are gas distribution means 376, which includes a tube 378, for supplying pressurized barrel gas to the feeder means 356.

In response to firing of the cannon 10, high pressure barrel gas is fed through the barrel passage 360 and the gas manifold passage 358 into the aperture 362. Gas pressure in the aperture 362 drives the piston 364 rearwardly, across the gap 230 between the manifold 24 and the barrel support 22, into sealing relationship with the support aperture 374, pressurized gas also flowing through the piston axial bore 366 into the distribution means 376 and on to the feeder means 356.

It is seen, particularly from FIGS. 7(*a*) and 7(*b*), that the cannon 10 is extremely compact with maximum advantage taken of the hollow support members 14 and 16 for housing or supporting various important portions of the cannon. By concentric arrangement, a number of "layers" of parts are formed, all of the parts being constructed in tubular form except for the guides 194 which lie along the axes of the members 14 and 16.

Thus, in a series of concentric rings about the drive spring guides 194, (in forward regions of the support members 14 and 16), are the drive spring 192, the piston assembly 208, the weights 270, the support members themselves, the springs 300 and finally the recoil cylinder assembly 208. Because at least major portions of all these various parts of the cannon 10 are generally cylindrical in shape, fabrication on conventional turning machines, such as lathes or barrel making equipment is made easy without requiring high degrees of machine operator skill.

Other advantages of the cannon 10 are also readily apparent from the foregoing description and the accompanying figures. While being rigid, the framework means 44 is substantially open; thus, weight of the cannon 10 is much less than that of conventional, closed receiver-type cannon. As an example, whereas the receiver of a conventional 35 mm calibre gas operated cannon weighs approximately 800 pounds, the open-framework receiver of the cannon 10, in the same calibre, weighs only about 300 pounds, an important weight savings of 500 pounds per cannon or 1000 pounds in a system using a pair of cannons.

This substantial weight savings is particularly important in highly mobile ground based weapons systems and in most airborn applications. Not only may the entire weapons systems be made correspondingly lighter in weight, but, alternatively, much more ammunition for the cannon may be carried without exceeding the weight of a system using conventional cannon.

Furthermore, because of the open-framework construction, ready access to the bolt assembly 26, as is necessary for inspection and maintenance, is provided. Major portions of the cannon 10 can be easily and rapidly removed for maintenance, repair or replacement by removing the two pins 88 which both mount the buffer assembly 18 to the support members 14 and 16 and retain the drive means 40 in such members.

With the buffer assembly 18 and drive means 40 removed, and without necessity for removing the cannon 10 from the cradle 328, the bolt assembly 26, with the entire bolt carrier recoil means 46 connected thereto, is easily withdrawn from the support members 14 and 16.

Also removed with the recoil means 46 are the inertia weights 270.

Such rapid and easy disassembly and reassembly is particularly important under field or combat conditions where equipment is minimal, time is ordinarily important and trained maintenance crews are usually unavailable.

Thus, in summary, the cannon 10, as compared to conventional, heretofore available, gas operated automatic cannon, is relatively easy and much less expensive to construct. Excessive construction lead time is not required, nor are complicated fabricating machinery or highly skilled machinists. The open nature of the configuration renders the cannon 10 comparatively lightweight and provides ready access to moving cannon parts for inspection, maintenance and repair. These latter features are particularly important under combat conditions where extreme reliability of operation is essential.

Although there has been described above a specific arrangement of an open-framework receiver, or substantially receiverless, gas operated automatic cannon, in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. In an automatic cannon weapons system having shell feed means, triggering means and cannon mount means, an open-framework receiver cannon, which comprises:

(a) a cannon barrel having a shell receiving, breech end and a barrel bore axis;

(b) reciprocating bolt means for enabling feeding and firing of the cannon; and (c) means for supporting the barrel and bolt means in operative relationship with the shell feed means and triggering means, said supporting means including a breech ring having means defining a breech aperture axially therethrough configured for receiving the breech end of the barrel; first and second elongate, rigid support members having forward and rearward ends and intermediate portions therebetween, means for fixing said intermediate portions to the breech ring in laterally spaced apart, symmetrical relationship with longitudinal axes of the members parallel to the barrel bore axis when the barrel is received in the breech ring; forward support means for rigidly interconnecting the member forward ends with the barrel when the barrel is received in the breech ring; means for receiving the bolt means and for guiding reciprocating movement thereof and means for rigidly interconnecting rearward ends of the support members, said means for interconnecting rearward ends of the support members including sear means for enabling searing up of the bolt means at a rearward position thereof.

2. In an automatic cannon weapons system having shell feed means, triggering means and cannon mount means, an open-framework receiver cannon, which comprises:

(a) a cannon barrel having a shell receiving, breech end and a barrel bore axis;

(b) reciprocating bolt means for enabling feeding and firing of the cannon; said bolt means including a bolt carrier, a bolt, means for slidably mounting the bolt to the bolt carrier for limited relative axial movement therebetween and locking means mounted to the bolt for locking the bolt against axial movement at a forwardmost position during firing of the cannon;

(c) means for supporting the barrel and bolt means in operative relationship with the shell feed means and triggering means, said supporting means including a breech ring having means defining a breech aperture axially therethrough configured for rotatably receiving the breech end of the barrel; first and second elongate, hollow rigid support members having forward and rearward ends; means for fixing the support members to the breech ring in laterally spaced apart, symmetrical relationship with longitudinal axes of the members parallel to the barrel bore axis when the barrel is received in the breech ring; forward barrel support means for rigidly interconnecting the member forward ends, with the barrel extending through an aperture formed in said support means when the barrel is received in the breech ring; means for receiving the bolt means and for guiding reciprocating movement thereof and means for rigidly interconnecting rearward ends of the support members; and (d) barrel gas operated recoil means for causing rearward recoil movement of the bolt carrier relative to the bolt in response to firing of the cannon, said recoil means including recoil pistons disposed in the support members and a barrel gas manifold fixed to the barrel forwardly of the forward barrel support means, the gas manifold being axially separated from the forward barrel support means and the support members when the barrel is received into the breech ring, thereby enabling rotational installation and removal of the barrel.

3. The open-framework cannon according to claim 2, wherein each of the first and second support members includes means defining an elongate slot through a side thereof, said slot extending rearwardly from the breech ring and facing towards the barrel bore axis, and wherein the recoil pistons include means for engaging opposite side portions of the bolt carrier through said elongate slots, the piston and the slots thereby also forming portions of the means for receiving and guiding the bolt assembly during reciprocating movement thereof.

4. The open-framework receiver cannon according to claim 3, wherein the barrel gas manifold includes means defining recoil gas passages therethrough communicating with passageways defined through sidewalls of the barrel and means responsive to flow through said passages of pressurized barrel gas caused by firing of the cannon for driving said pistons, and hence the bolt carrier connected thereto, rearwardly in recoil.

5. The open-framework receiver cannon according to claim 4, wherein the piston driving means includes a pair of actuating elements axially slidably mounted in the manifold forwardly adjacent to, and axially aligned with, the recoil pistons, said elements being operative for being driven rearwardly into driving engagement with the recoil pistons by pressurized barrel gas flowing through said recoil gas passages after firing of the cannon and being recessed forwardly into the manifold at all other times.

6. The open-framework receiver cannon according to claim 5, wherein the weapons system shell feed means includes a gas operated shell feeder, wherein the barrel gas manifold includes means defining a feeder gas passage communicating with a gas passage defined through a sidewall of the barrel; and including means for supplying pressurized barrel gas from the manifold feeder gas passage to the forward barrel support and thence to the shell feeder for operation thereof in response to firing of the cannon, said shell feeder gas supplying means including an actuating element axially slidably mounted in the manifold, said element being operative for being driven rearwardly into engagement with the forward barrel support by pressurized barrel gas flowing through said feeder gas passage after firing of the cannon and being recessed forwardly into the manifold at all other times.

7. In an automatic cannon weapons system having shell feed means, triggering means and cannon mount means, an open-framework receiver cannon, which comprises:

(a) a cannon barrel having a shell receiving, breech end and a barrel bore axis;

(b) reciprocating bolt means operative for feeding and firing of the cannon; said bolt means including a bolt carrier, a bolt, means for slidably mounting the bolt to the bolt carrier for limited relative axial movement therebetween and locking means mounted to the bolt for locking the bolt at a forwardmost position during firing of the cannon, the bolt carrier having portions configured for interfering with the locking means to prevent unlocking of the bolt when the bolt carrier is at a forward position;

(c) means for supporting the barrel and bolt means in operative relationship with the shell feed means and triggering means, said supporting means including a breech ring having means defining a breech aperture axially therethrough configured for receiving the breech end of the barrel; first and second elongate, hollow rigid support members having forward and rearward ends and intermediate portions therebetween, means for fixing said intermediate portions to the breech ring in laterally spaced apart, symmetrical relationship with longitudinal axes of the members parallel to and coplanar with the barrel bore axis when the barrel is received in the breech ring; barrel support means for rigidly interconnecting the member forward ends with the barrel when the barrel is received in the breech ring; means for receiving the bolt means and for guiding reciprocating movement thereof and means for rigidly interconnecting rearward ends of the support members;

(d) sear means responsive to the weapons system triggering means for searing up the bolt assembly at a position relatively adjacent to the means interconnecting rearward ends of the support members;

(e) recoil means disposed in the support members for causing rearward recoil movement of the bolt carrier relative to the bolt in response to firing of the cannon to thereby move said bolt carrier interfering portions out of interference with the bolt locking means to enable unlocking of the bolt; and (f) drive means disposed inside the support members and connected to said bolt means for driving the bolt means, upon unsearing thereof, forwardly towards the breech ring, said drive means including a pair of elongate coil springs and spring guides releasably disposed in the support members and extending forwardly from the rearward ends of the support members for substantially the entire length thereof, forward ends of the springs being in engaging relationship with corresponding portions of the recoil means.

8. In an automatic cannon weapons system having shell feed means, triggering means and cannon mount means, an open-framework receiver cannon, which comprises:

(a) a cannon barrel having a shell receiving, breech end and a barrel bore axis;

(b) reciprocating bolt means for causing feeding and firing of the cannon; and (c) means for supporting the barrel and bolt means in operative relationship with the shell feed means and triggering means, said supporting means including a breech ring having means defining a breech aperture axially therethrough configured for receiving the breech end of the barrel; first and second elongate, rigid support members having forward and rearward ends; means for fixing the support members to the breech ring in laterally spaced apart, symmetrical relationship with longitudinal axis of the members parallel to, and coplanar with, the barrel bore axis when the barrel is received in the breech ring, barrel support means for rigidly interconnecting the member forward ends with the barrel when the barrel is received in the breech ring; means for rigidly interconnecting rearward ends of the support members and means for receiving the bolt means and for guiding reciprocating movement thereof, said means for receiving and guiding the bolt means including a plate longitudinally extending between the breech ring and the means for rigidly interconnecting rearward ends of the support members and disposed below the barrel bore axis, said plate including bolt means engaging tracks and means defining an axially elongated ejection port for enabling fired shell casings to be ejected downwardly therethrough.

9. In an automatic cannon weapons system having shell feed means, triggering means and cannon mount means, an open-framework receiver cannon, which comprises:

(a) a cannon barrel having a shell receiving, breech end and a barrel bore axis;

(b) reciprocating bolt means for feeding and firing the cannon; and (c) means for supporting the barrel and bolt means in operative relationship with the shell feed means and triggering means, said supporting means including, a breech ring having means defining a breech aperture axially therethrough configured for receiving the breech end of the barrel; first and second elongate, rigid support members having forward and rearward ends; means for fixing the support members to the breech ring in laterally spaced apart, symmetrical relationship with longitudinal axes of the members parallel to, and coplanar with, the barrel bore axis when the barrel is received in the breech ring; barrel support means for rigidly interconnecting the member forward ends when the barrel is received in the breech; means for receiving the bolt means and for guiding reciprocating movement thereof; means for rigidly interconnecting rearward ends of the members and means for compliently mounting the cannon to the cannon mount means for limited axial cannon recoil and counter recoil movement relative thereto;

said means for compliently mounting the cannon to the cannon mount means including first and second rigid, tubular recoil cylinders disposed around portions of the first and second support members, respectively, intermediate the breech ring and the barrel support means, and including axially compressable recoil spring means disposed between the recoil cylinder members and the respective support members and providing interconnections therebetween, said recoil spring means opposing relative axial movement between the recoil cylinders and the support members in both axial directions.

10. The open-framework receiver cannon according to claim 9, wherein the means for compliently mounting the cannon to the cannon mount means includes outwardly projecting lugs formed on the first and second recoil cylinders and fasteners for releasably fastening the lugs to said cannon mount means, said lugs being formed symmetrically about the barrel bore axis and coplanar therewith.

11. In an automatic cannon weapons system having shell feed means, triggering means and cannon mount means having laterally spaced apart first and second cannon mounting tracks, an open-framework receiver cannon, which comprises:

(a) a cannon barrel having a shell receiving, breech end and a barrel bore axis;

(b) reciprocating bolt means for feeding and firing the cannon; and (c) means for supporting the barrel and bolt means in operative relationship with the shell feed means and triggering means, said supporting means including a breech ring having means defining a breech aperture formed axially therethrough configured for receiving the breech end of the barrel; first and second elongate, rigid support members having forward and rearward ends; means for fixing the support members to the breech ring in laterally spaced apart, symmetrical relationship with longitudinal axis of the members parallel to, and coplanar with, the barrel bore axis when the barrel is received in the breech ring; barrel support means for rigidly interconnecting the member forward ends with the barrel when the barrel is received in the breech ring; means for receiving the bolt means and for guiding reciprocating movement thereof and means for rigidly interconnecting rearward ends of the support members, said breech ring, barrel support means and means for rigidly interconnecting rearward ends of the support members each including means for slidably engaging said tracks, to thereby limit recoil and counterrecoil movement of the cannon relative to the cannon mount means to movement along side tracks.

12. The open-framework cannon according to claim 11, wherein said means for slidably engaging the tracks include track engaging transverse pairs of lugs formed symmetrically about the barrel bore axis and coplanar therewith.

* * * * *